United States Patent [19]

Thompson

[11] Patent Number: 4,772,187

[45] Date of Patent: Sep. 20, 1988

[54] ROTARY PUMP

[76] Inventor: George A. Thompson, 114 Demotte Ave., Daytona Beach, Fla. 32019

[21] Appl. No.: 905,010

[22] Filed: Sep. 8, 1986

[51] Int. Cl.[4] ..... F04C 18/11; F01C 21/00

[52] U.S. Cl. ..... 418/46; 418/178; 418/191; 418/227; 418/152

[58] Field of Search ..... 418/152, 178, 179, 191, 418/225, 227, 46

[56] References Cited

U.S. PATENT DOCUMENTS

| | | | |
|---|---|---|---|
| 1,224,567 | 5/1917 | Ragan | 418/191 |
| 1,704,938 | 3/1929 | Gardes | 418/191 |
| 2,786,332 | 3/1957 | Taverniers | 418/191 |
| 3,117,562 | 1/1964 | Hajet | 418/191 |
| 3,289,649 | 12/1966 | Lamm | 418/178 |
| 3,366,096 | 1/1968 | Mathews | 418/191 |
| 3,453,992 | 7/1969 | Graham | 418/191 |
| 3,612,735 | 10/1971 | Graham | 418/191 |
| 3,621,820 | 11/1971 | Newsom | 418/191 |
| 3,622,256 | 11/1971 | Borisoglebsky | 418/201 |
| 3,989,413 | 11/1976 | McGahan | 418/191 |
| 4,086,880 | 5/1978 | Bates | 418/191 |
| 4,490,102 | 12/1984 | Carré | 418/178 |

*Primary Examiner*—William L. Freeh
*Assistant Examiner*—Jane E. Obee
*Attorney, Agent, or Firm*—Sughrue, Mion, Zinn, Macpeak, and Seas

[57] ABSTRACT

A single rotary pump is provided with a driven valve having outer curved faces and inner curved recesses along the major axis thereof, a rotary piston having vanes between which there are semi-ellipses having raised portions therebetween, said valve being driven by an external source to cause rotation of said piston whereby liquid under pressure flows from an inlet of the pump to an outlet of the pump.

4 Claims, 1 Drawing Sheet

ROTARY PUMP

BACKGROUND OF THE INVENTION

1. Field of the Invention

This invention pertains to rotary pumps and specifically to a rotary pump construction having a pair of rotors with intermeshing vanes.

2. Background of the Prior Art

The prior art shows rotary pumps or compressors wherein rotors having vanes cooperate with oppositely rotating valves to provide a pumping action. Representative of the prior art are the following list of patents and copies are furnished for the record.

| Inventor | Patent No. |
|---|---|
| A. W. Gardes | 1,704,938 |
| P. Taverniers | 2,786,332 |
| A. Graham | 3,612,735 |
| F. F. Newsom | 3,621,820 |
| McGahan et al | 3,989,413 |
| Bates | 4,086,880 |

SUMMARY OF THE INVENTION

There is a need for a rotary pump construction which is simple and inexpensive to construct, yet is efficient in operation.

It is therefore one object of this invention to provide a rotary pump construction having a rotary piston spaced from and cooperating with an oppositely rotating valve to provide an efficient pumping action to provide cooling thereof.

It is another object of this invention to provide a single rotary pump including a piston having a plurality of vanes between which there are semi-ellipses which cooperate with the valve to compress air to high pressure within the pump.

It is yet another object of this invention to provide a rotary pump wherein the valve has curved portions extending along the major axis forming a groove of sufficient extent to receive therein the vanes of the piston as the vanes pass the valve.

It is still another object of this invention to provide a rotary pump wherein the piston and valve are spaced from each other and wherein the pump is self-cleaning by reason of the differential in pressure created on opposite sides of the vanes of the piston.

And still another object of this invention is to provide a rotary pump wherein the valve makes two rotations for each rotation of the piston thus providing an efficient yet inexpensive pump construction.

Another object of this invention is to provide a rotary pump which may be driven by pulley or by gear and which provides constant flow running in either direction.

These and other object of the invention will become apparent to those skilled in the art to which the invention pertains from a reading of the following specification when taken in light of the annexed drawings.

DETAINED DESCRIPTION OF THE PREFERRED EMBODIMENT OF THE INVENTION

Figure 2:
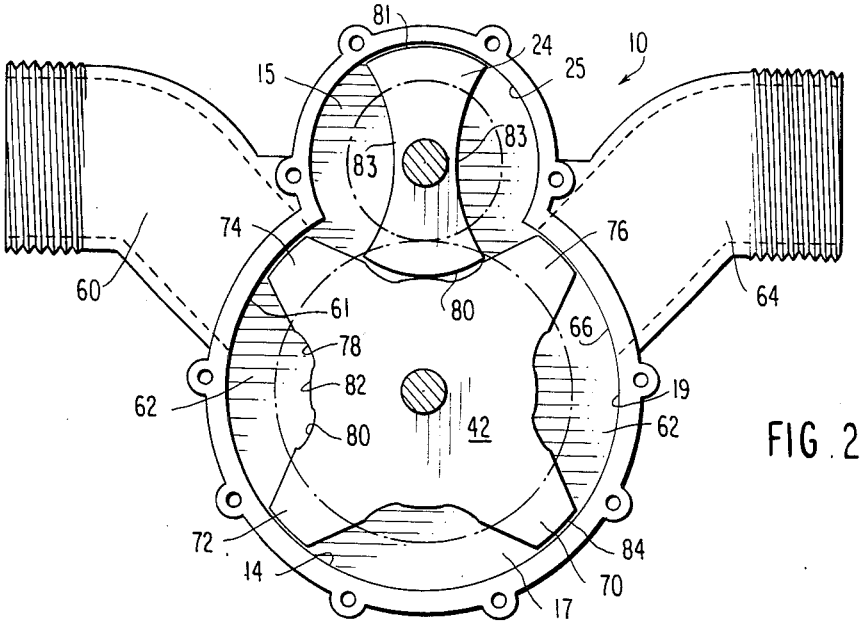
FIG. 2 is a view in section of the pump taken along the line 2—2 of FIG. 1 showing the lower rotary piston and the upper rotary valve together with an inlet and an outlet.
Figure 1:
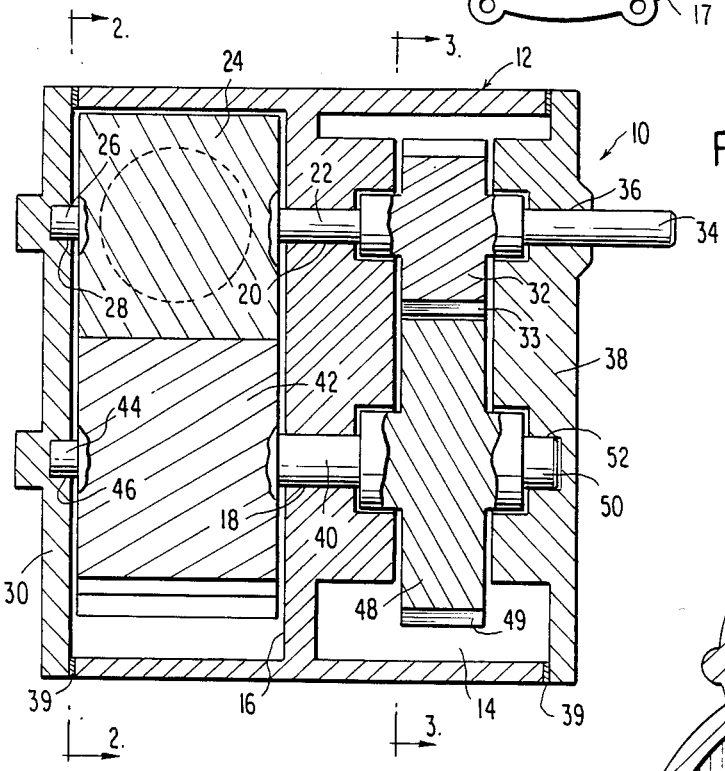
FIG. 1 is a view in section of a rotary pump showing on the left side the lower rotary piston and the upper rotary valve and showing on the right side the gears for effecting rotary movement of the piston and valve.

Referring now in more detail to the drawings, FIGS. 1 and 2 show a pump 10 having a cylindrical body 12 which has a hollow chamber 14 separated from an upper chamber 15 and a lower chamber 17 by a dividing wall 16 with apertures 18 and 20 therethrough. Aperture 20 permits passage of a shaft 22 on which there is journaled a valve 24. The end 26 of the shaft 22 is rotatably received in a bearing recess 28 in a closure outer end plate 30. The opposite end of the shaft 22 has secured thereto a driving gear 32 having teeth 33 thereon. The outer distal end 34 of the shaft 22 passes through an opening 36 in the inner closure wear plate 38. It will be appreciated that the end 34 of shaft 22 is driven by a source of power as is well known in the art.

The opening 18 in wall 16 permits passage of a shaft 40 upon which is journaled at one end a rotor or piston 42. The end 44 of the shaft 40 is rotatably received in bearing recess 46 in the outer closure wear plate 30. The opposite end of shaft 40 has secured thereto a gear 48 having teeth 49 thereon. The outer distal end 50 of the shaft 40 is rotatably received in a bearing recess 52 in the inner closure wear plate 38. As seen in FIG. 2, pump 10 has an inlet passage 60 having a port 61 communicating with the interior 62 of the lower chamber 17. An outlet passage 64 has a port 66 similarly communicating with the interior 62 of the lower chamber 17.

The rotor 42, FIG. 2, has a plurality of vanes 70, 72, 74 and 76 between adjacent one of which there are semi-ellipses 78 and 80 separated by a raised portion 82. The outside curved faces 84 (only one described) of the vanes extend adjacent to but do not touch the inner curved periphery 19 of the chamber 17. The valve 24 has outer curved faces 81 (only one described) which sweep about the curved surface 25 of the upper chamber 15 and inwardly curved inner recesses or faces 83 which receive in sealing engagement thereto the outside faces 84 of the vanes 70, 72, 74 and 76. As will be appreciated, as the piston 42 makes one revolution, the valve 24 makes two revolutions and each of the vanes 70, 72 and 76 engage in sealing relationship the recesses 83 of the valve 24 during its two revolutions. By this construction, no pumped liquid can pass through chamber 15 between the valve 24 and the piston 42. Rather, the liquid passes between the vanes in the lower chamber 17 and is forced to rise and pass through the discharge passage 64. As the piston 42 rotates, the outer curved faces 81 of the valve 24 extend to but do not touch the semi-ellipses 78 and 80 or the raised portion 82 of the piston 42. The extent of near contact is such that air is compressed to form high pressure pockets of air as the curved faces 81 pass over the semi-ellipses 78 and 80. The release of the high pressure pockets of air on the intake or suction side 60 of the pump causes turbulence which functions to clean the piston and cause sediment to pass out the discharge side 64 with the liquid.

Figure 3:
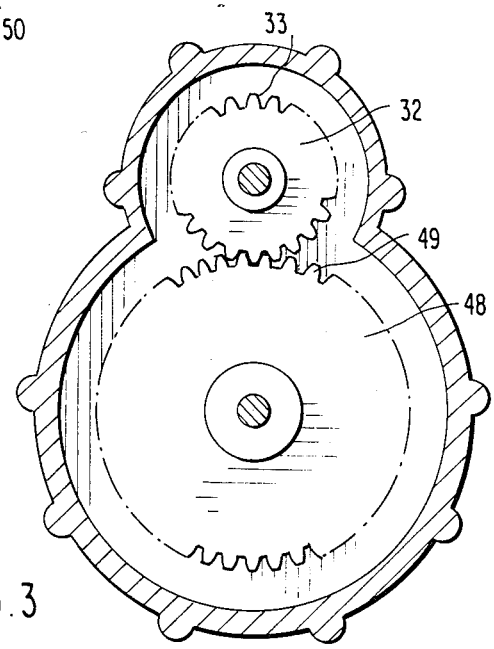
FIG. 3 is a view in section of the pump showing gears for effecting rotary movement of the piston and valve, taken along the line 3—3 of FIG. 1.

The gear wheel 32, FIG. 3, of the valve 24 has one-half the diameter of the gear wheel 48 of the piston 42. The teeth 33 and 49 mesh in the usual fashion. The gears 32 and 48 are housed in chamber 14. The end wear plates 30 and 38 are self-lubricating and are made of material such as celluloid which provides a low coefficient of heat and friction and thus provides long life. The end 34 of shaft 22 has a tight mechanical seal with the bore 36 to prevent leakage as does the end wear plates 30 and 38 have adjacent the edges 39 of the housing 12.

While the invention has been described with regard to a preferred embodiment thereof, it will be appreciated to those skilled in the art to which the invention pertains that numerous changes may be made in the construction of this pump without departing from the spirit and scope thereof.

What I claim is:

1. A constant flow, bi-directional, rotary liquid pump for pumping sediment-containing liquid in either direction between an inlet and an outlet, comprising:

a pump housing having an inlet, an outlet and a hollow interior;

said housing having an upper chamber and lower chamber in said hollow interior;

a rotary piston in said lower chamber;

drive means for rotating said valve and said piston in opposite directions so that said valve and said piston interact to cause liquid to pass under pressure from said inlet to said outlet;

said drive means rotating said valve at twice the rate at which said piston is rotated;

said hollow interior having a drive chamber, in which said drive means is located, and a partition separating and liquid-sealing said drive chamber form said upper and lower chambers;

said valve having convex-curved outer faces which, during rotation, is spaced from the inner surfaces of said upper chamber, and having concave-curved inner faces extending along a major axis thereof;

said piston having four equally-spaced, radially-fixed vanes, between adjacent ones of which are two semi-ellipses having therebetween a convex outwardly raised portion; and said vanes having outer convex-curved faces interacting with said concave-curved inner faces of said valve to provide a liquid-tight seal, whereby liquid is prevented from passing between said valve and said piston through said upper chamber, and said convex-curved outer faces of said valve interacting with said semi-ellipses and said raised portion to create high pressure pockets of air which are discharged into the liquid entering through said inlet of said pump and are entrained with the liquid to create turbulence which functions to help move the sediment through the pump with the liquid;

said convex-curved outer faces of said valve extending in close proximity to said semi-ellipses of said raised portion during rotation, and said convex-curved outer faces of said vanes extending to and spaced from said lower chamber during rotation.

2. A rotary pump according to claim 1, wherein said drive means comprises intermeshing piston and valve gears having a ratio of two to one whereby said valve makes two revolutions for one revolution of said piston;

a drive shaft fixed to said valve and to said valve gear;

a driven shaft fixed to said piston and to said piston gear;

first and second end wear plates mechanically sealed against opposite ends, respectively, of said housing to prevent leaks therefrom; and said wear plates having bearing recesses for receiving opposite ends of said shafts.

3. A rotary pump according to claim 2, wherein said end wear plates are constructed from synthetic chemical material which provides self-lubrication and which has low co-efficients of heat and friction.

4. A rotary pump according to claim 3, wherein said synthetic chemical material is celluloid.

* * * * *